United States Patent [19]

Stone et al.

[11] 4,033,885

[45] July 5, 1977

[54] APPARATUS FOR COLLIMATION OF RADIATION SIGNALS FOR LONG DISTANCE TRANSMISSION AND METHOD OF CONSTRUCTION THEREFOR

[75] Inventors: Leonard R. Stone, South Euclid; Steven J. Aron, Jr., Parma; Robert A. Kemmerling, Cleveland Heights, all of Ohio

[73] Assignee: Republic Steel Corporation, Cleveland, Ohio

[22] Filed: Dec. 30, 1974

[21] Appl. No.: 537,458

Related U.S. Application Data

[63] Continuation of Ser. No. 381,671, July 23, 1973, abandoned.

[52] U.S. Cl. ..... 250/496; 250/359; 250/497

[51] Int. Cl.[2] ..... G21F 5/02

[58] Field of Search ..... 250/341, 359, 493, 496, 250/497, 308, 312

[56] References Cited

UNITED STATES PATENTS

| | | | |
|---|---|---|---|
| 2,377,589 | 6/1945 | Sutcliffe | 250/308 |
| 2,675,485 | 4/1954 | Scag | 250/515 |
| 3,058,023 | 10/1962 | George | 250/251 |
| 3,185,843 | 5/1965 | Hansen | 250/308 |
| 3,222,524 | 12/1965 | Lee | 250/496 |
| 3,543,384 | 12/1970 | Hansen | 29/471.1 |
| 3,581,090 | 5/1971 | Brown | 250/363 |
| 3,683,186 | 8/1972 | Tompkins | 250/359 |
| 3,693,012 | 12/1972 | Schmieder | 250/496 |
| 3,778,614 | 12/1973 | Hounsfield | 250/359 |
| 3,808,437 | 4/1974 | Miyagawa | 250/496 |

*Primary Examiner*—Harold A. Dixon

*Attorney, Agent, or Firm*—Watts, Hoffmann, Fisher & Heinke Co.

[57] ABSTRACT

A radiation energy transmission system including source collimating apparatus and its method of construction for maintaining the intensity of a radiation signal emanating from a radiation source along a narrow signal beam path to provide for long distance transmission of the collimated signal sufficiently above background radiation level to be detected by detector means within the path of the beam and at the same time sufficiently below safe radiation exposure levels so as not to be harmful to personnel in the immediate area of the beam.

3 Claims, 6 Drawing Figures

APPARATUS FOR COLLIMATION OF RADIATION SIGNALS FOR LONG DISTANCE TRANSMISSION AND METHOD OF CONSTRUCTION THEREFOR

This is a continuation, of application Ser. No. 381,671, filed 7/23/73, and now abandoned.

BACKGROUND OF THE INVENTION

This invention relates broadly to radiant energy and is more particularly concerned with applications of ray generation and their transmission for purposes of detection, indication or measurement.

Radiant energy such as in the form of nuclear radiation has been increasingly used as a means to detect various physical parameters related, for example, to distance, measurement, object physical charateristics, etc. Various types of instruments have been designed using such radiant energy for purposes of long distance signalling, distance measurement and interlocking of equipment, and control of the operation of equipment. Such measurements have been termed, in some cases, transmission gauges wherein there is generally provided in aligned radiation source and radiation detector together with interconnected control apparatus which function together to detect, indicate or otherwise measure a physical characteristic of an object or material positioned or supported within a radiated beam established between the source and detector. An example of such a transmission gauge is shown in U.S. Pat. No. 3,373,286 wherein physical characteristics of the material to be tested are placed on a conveyor belt in a manner to pass within the radiated beam established between a radiation source and a detector.

Collimators have been employed with apparatus either in combination with a detector for purposes of what is termed focusing of the source as in U.S. Pat. No. 3,373,286 or in combination with the source to provide a defined radiation beam as produced from the radiation source, such as shown in U.S. Pat. Nos. 3,013,157 and 3,058,023. In the case where the collimator is part of the radiation source, the main purpose of the collimator is taught to be utilized to restrict the area or diametrical extent of the radiation beam. In the case of U.S. Pat. No. 3,013,157, the collimator strictly provides a means by which area or size of the radiation source itself can be measured, whereas in U.S. Pat. No. 3,058,023 the collimator provides the means for forming the gaseous molecules, as therein defined, which are evaporated from a liquid charged source and formed into a collimated beam.

However, it is not known to employ a source collimator in a radiant energy transmission system in a manner to maintain the radiation intensity so that it does not decrease as an inverse function of the square of the distance from the source collimator; in applications necessitating long distance transmission of radiant energy where the radiated energy intensity level must be sufficiently higher than background radiation to be capable of detection by and, therefore, useful to the detector unit and interconnected control apparatus.

Prior art radiation transmission systems utilizing a relatively strong source shielded by a container having a single collimating hole have been employed in "unoccupied" (by humans) areas for long distance signaling.

One usual manner of assuring sufficient radiation intensity level in such systems is to provide a stronger radiation source. This increases the signal-to-noise ratio but is at the expense of surpassing the radiation intensity levels considered safe for working personnel. The dosage rate of 2.5 mr./hr. is the safe level standard set by the Atomic Energy Commission. A stronger source of itself is not the answer but rather the provision of a source which, when collimated, is effectively a low intensity source for safety purposes, yet provides a beam of sufficient strength to be easily detected at long transmission distances, such as 50 feet upwards to several hundred feet.

A particular application of concern relates to the detection of the presence or absence of an object moving on a conveyor system so as to operate at precise moments various types of equipment to automatically perform an operation on the object when in the presence of any such piece of equipment. In particular, the application involves an automated hot strip mill wherein detection means has been employed in the past to determine the location of a steel slab relative to a working station, such as a descaler or crop shear. The detection means previously employed was an infrared ray system having infrared energy source which has the disadvantage of not being completely reliable because steam or intense vapor from the descaling operation would interfere with the infrared signal causing the detecting system not to produce a signal indicative that a slab was or was not present at the descaler or near the entrance of the crop shear. What is needed, therefore, is a more reliable detection system wherein the steam or vapor from the descaling operation will not interfere with slab detection even though there may be a large distance involved between the energy source on one side of the strip mill lane and the detecting unit supported in aligned relation on the other side of the strip mill line.

In contemplating the employment of a detection system employing a gamma radiation signal which is not interfered with by steam or a heavy vaporous atmosphere, present practice would be to employ a radiation source that would exceed the safe exposure rate of 2.5 mr./hr. in order to produce a gamma radiation signal of sufficient intensity for long distance transmission, such as 50 to several hundred feet, as well as at a tolerable intensity above background radiation level. It is unusual to be able to obtain a sufficiently detectable gamma radiation signal above background radiation level at distances of several hundred feet without exceeding a safe exposure rate of gamma radiation.

SUMMARY OF INVENTION

The principal object of the present invention is the provision of radiant energy transmission system employing a nuclear energy source collimator adapted to provide and to relatively maintain over long distances a highly collimated beam of radiation of a sufficiently low level to permit working personnel to be present within the immediate area where the system is in operation.

In particular, the system comprising this invention is especially adapted to detect the presence or absence of an object which may or may not be obstructing a gamma-ray beam established between a radioactive source and a detector. A highly collimated radiation beam is produced through an elongated collimator assembly which is integral with the radiation source. The collimator completely shields the source so that all gamma radiation is directed into the collimator.

The source collimator comprising this invention is designed to provide for useful gamma radiation levels which can be adequately detected at several hundred feet from the source, at the same time safe radiation exposure levels for working personnel are maintained at the energy source and at any distance within the radiation beam or path established between the source and the detector. The source collimator provides for a gamma radiation signal or beam of narrow width or magnitude whose intensity at any point along the collimated beam up to several hundred feet from the source is maintained below safe exposure level for working personnel but has a sufficiently maintained intensity level above background radiation levels to produce a radiation signal readily detectable by the gamma radiation detector unit.

The collimator includes a plurality of elongated parallel members which are preferably of about equal length and of about the same cross-sectional area and configuration. These members are bound together in any desirable manner to form a rigid assembly. The members may be of any variety of geometrical cross-sectional configuration, such as, circular, square, hexagonal or any other polygonal configuration. In connection with any such configuration, the members may be in the form of either rod or tube shapes.

The assembled members provide for a plurality of elongated, aligned passages between each other which provide for small discrete collimating paths for the radiation to emerge from the collimator in parallel alignment forming a very narrow width radiation band. When taking into consideration the type of transmission range and signal tolerance desired, the type of collimator, i.e. for example tubing or rod size, can be selected to produce a highly collimated beam which consists of a number of narrow parallel beams of radiation. The net intensity of the beams will not appear to follow an inverse square relationship for substantially large transmission distances.

Another object of the present invention is the provision of an object detection system which is reliable with regard to detection and operation of controls for equipment in poor visibility areas. Other systems employing a photoelectric or infrared ray detecting medium are not as reliable as nuclear energy as a detecting medium. This is due to the possibility of signal error due to undesirable obstruction by some other physical element such as smoke, fog or vaporous atmosphere, which nuclear energy such as controlled gamma radiation will penetrate.

Accordingly, a major object of this invention is to generally provide a highly collimated radiation beam capable of being effectively transmitted safely a large distance to a detector and a method and apparatus using such a beam and detector.

Other objects and advantages of the present invention will become apparent from the following detailed description when read in connection with the accompanying drawings wherein.

DESCRIPTION OF PREFERRED EMBODIMENT

Figure 1:
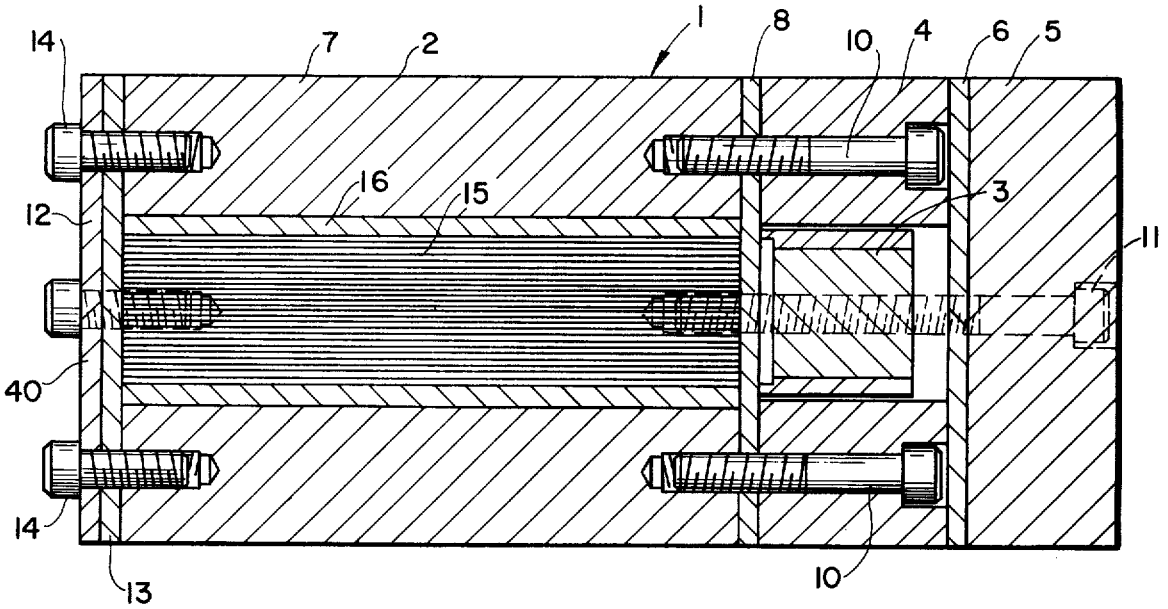
FIG. 1 is a longitudinal cross-sectional view of the source collimator comprising this invention.

Reference is now made to FIG. 1 wherein there is shown the source collimator comprising this invention. The collimating unit 1 includes integral combination of the collimator structure 2 and the radiation source 3. In general, the radiation source 3 is positioned within the housing 4 and enclosed by the cap or end member 5 in combination with the sealing member 6. The other side of the radiation source 3 is enclosed by means of the cylindrical mounting support 7 of the collimator 2 and the sealing member 8. Fastening means such as the bolt members 10 are utilized to secure the mounting support 7 to the source support 4 while bolt members such as that illustrated at 11 are used to secure the end cap 5 to the source support 4.

The other end of the mounting support 7 of the collimator 2 is provided with an end plate 12 and sealing members 13 secured in position by means of the bolt members 14.

Figure 2:
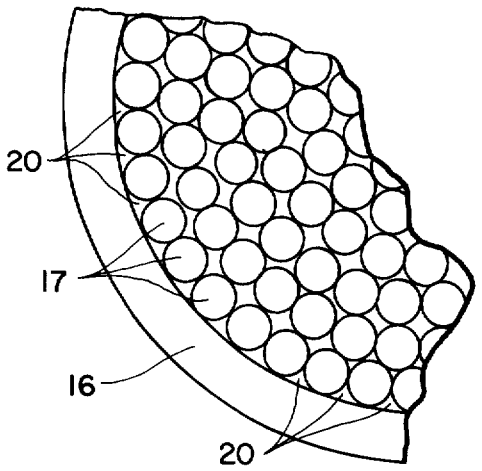
FIG. 2 is an end view of the collimator housing employing a plurality of elongated parallel rods as the collimating members.
Figure 3:
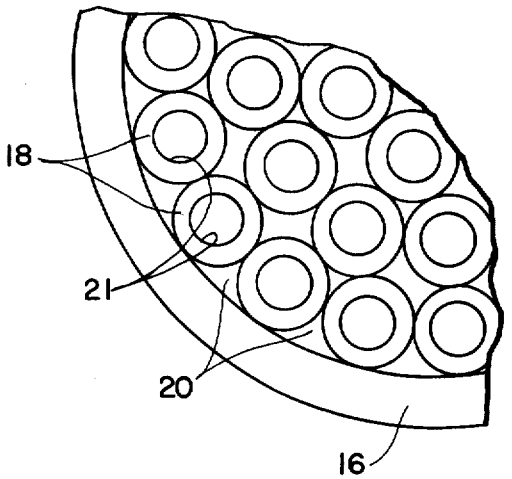
FIG. 3 is another end view of the collimator housing employing a plurality of elongated parallel rods as the collimating members.

The area designated at 15 in FIG. 1 comprises a plurality of collimating members shown in greater detail in FIGS. 2 and 3. These collimating members are housed within the cylindrical housing 16 mounted within the support 7.

The collimating members as illustrated in FIGS. 2 and 3 represent two specific configurations for such members. As shown in FIG. 2 the collimating members 17 comprise a plurality of elongated parallel rod members 17 which are provided to have identical cross-sectional areas and are all of equal length. On the other hand as shown in FIG. 3, the collimating members 18 are tubular. In both cases the collimating members 17 and 18 are bound together to form a rigid assembly within the housing 16.

It should be readily understood that the collimating members 17 and 18 as assembled form a plurality of elongated parallel passages generally indicated in FIGS. 2 and 3 at 20 which provide for a highly collimated radiation beam for purposes of transmission of the radiation energy provided by source 3. Due to the length of the collimator 2 as illustrated in FIG. 1, a highly collimated beam can be produced which has a substantially narrow beam width and capable of being transmitted for substantially long distances without a substantial loss in the intensity of radiation detected. Thus, the high collimation of such radiation is accomplished by collimator configurations as shown in FIGS. 2 and 3 through the means of the formation of the elongted passages 20 as well as in addition to the inner tubular passages 21 of the collimator members 18 of FIG. 3.

The design of the source collimator as shown in FIG. 1 has been found to alleviate the problem of the necessity of a higher level of radiation intensity to be employed at the radiation source container such as the case of gamma ray transmission, particulaly in connection with the transmission of such rays or beams over distances of fifty feet or more. The collimator 2 accomplishes the relative maintenance of a high level radiation intensity over such long distances by producing a highly collimated beam with the employment of medium or low energy radiation. Because of the narrowness of the width or diameter of the collimator compared to its length, as shown in FIG. 2, the radiated beam permits detection at greater distances as compared with the broad beam type of transmission. This is because a broad beam is spread over a larger solid angle. The narrow radiation beam delineated by the collimating members 15 can be pinpointed on the detector within the confines of the detector crystal. The radiation intensity between the radiation source and the detector will begin to gradually decrease in regards to count rate only when the beam width or diameter, as produced by the aggregate of the elongated, parallel passages, begins to become slightly larger than the diameter of the detector crystal. At a point more distant from the source, the portion of the beam resulting from a single parallel passage begins to accede the diameter of the detector crystal. From this point the radiation intensity of the beam will commence to follow an inverse square relationship, that is, the intensity measured by counts per minute will begin to decrease inversely with the square of the distance from the radiation source. The important point to be established here is that the application of the inverse square law does not apply for a large distance. Long distance transmission of nuclear radiation, such as gamma radiation, can be realized for purposes of detection, indication and measuring when utilizing the source collimator comprising this invention. By the same token, the beam or signal produced is quite safe to working personnel within the area of the radiant energy transmission system. The level of radiation at the source or at any distance from the source along the radiation beam or signal as produced is much less than the standard set by the Atomic Energy Commission which is less than or equal to 2.5 mr./hr.

Figure 4:
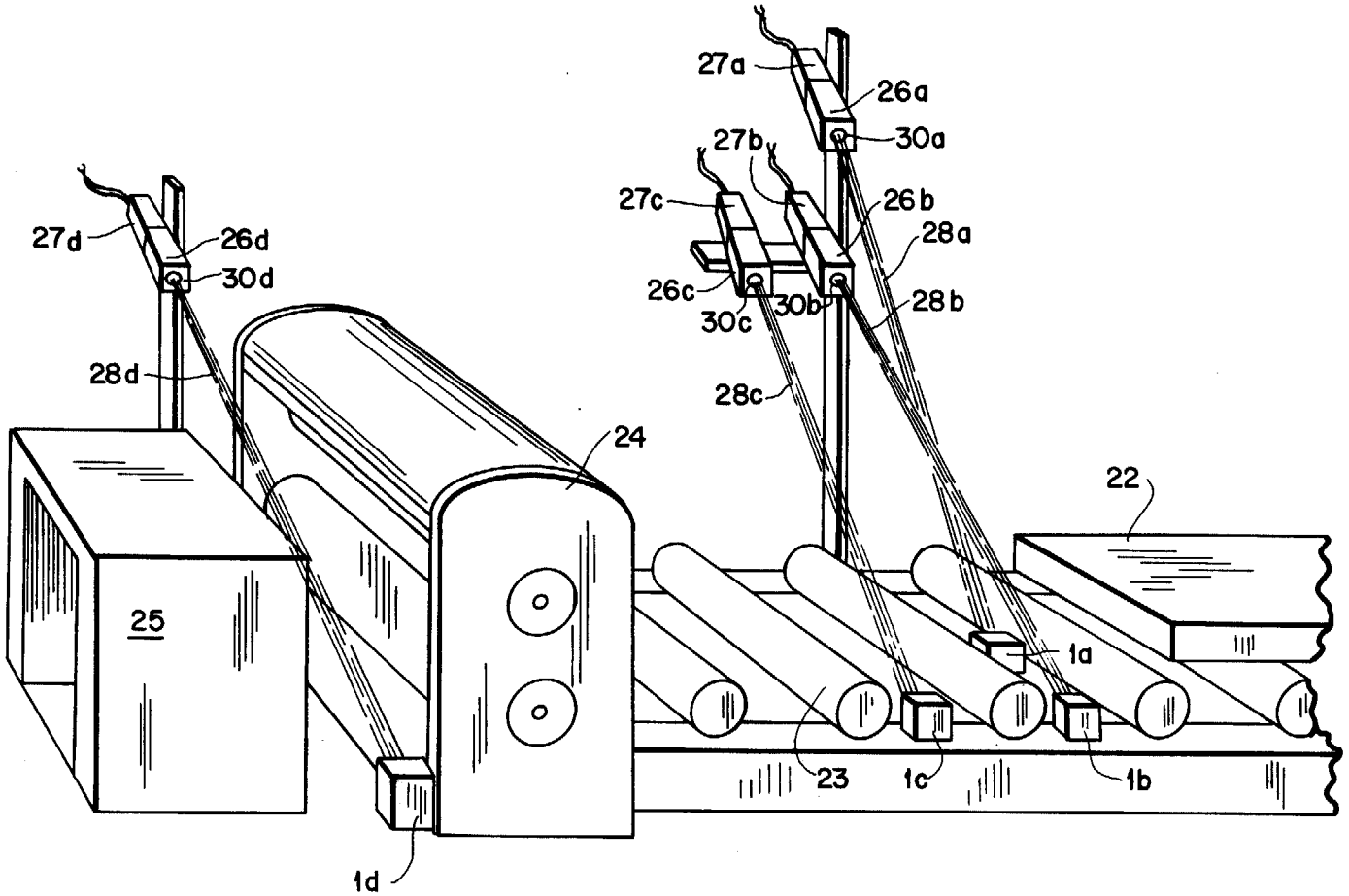
FIG. 4 is a diagrammatically illustrated perspective view of a particular application of the radiant energy transmission system comprising this invention.

A typical application of the radiant energy transmission system disclosed herein is illustrated diagrammatically in FIG. 4. In general, there is shown a hot strip mill lane wherein the slab 22 is proceeding down the conveyor system 23 toward the crop shear 24 and descaler 25. In FIG. 4 there is provided four source collimators 1*a* through 1*d* positioned in a manner to provide the respective highly collimated radiation beams or signals 28*a* through 28*d* which are aligned toward the respective detectors 26*a* through 26*d*, each of which is provided with a detector crystal 30*a* through 30*b*, respectively. Each of the detectors 26*a* to 26*d* is also provided with a signal circuit means generally indicated at 27*a* to 27*d*. The circuit means 27*a* to 27*d*, as is well known in the art, are responsive to the detector crystal 30*a* to 30*d* which is excited by means of the radiation beam 28*a* to 28*d*.

From the foregoing description, it can readily be seen that as the slab 22 moves along the conveyor 23, the slab will readily be detected by detectors 26*a* to 26*c* as the slab 22 interrupts the established radiation beam or signals 28*a* to 28*c*. The electrical signal produced by the circuit means 27*a* to 27*c* can be used to operate the hot strip mill equipment such as the shear 24. Also, the slab 22 while traveling along the conveyor 23 will interrupt the established radiation signal 28*d* between the radiation source 1*d* and detector 26*d*. The signal produced by the circuit means 27*d* can be utilized to operate the descaler 25 after the slab 22 has passed the shear 24.

As previously explained, the type of detection system utilized in the past for this particular application has been one that employs infrared energy. The beam or signal established by such energy is not reliable in connection with a hot strip mill since steam and heavy vaporous conditions caused by quenching operations interfere or otherwise obstruct the infrared signal from reaching the detector. In connection with the radiant energy transmission system of this invention, the source employed is productive of gamma radiation which is not interfered with or otherwise obstructed by the heavy vaporous atmosphere produced during the operation of the hot strip mill.

At the same time, the collimating unit of this invention provides a highly collimated, low intensity beam which is detectable at greater distances than previously employed. The unit also provides for safe transmission which is not hazardous to working personnel in the immediate vicinity of the hot strip mill lane.

The photon emission rate in terms of the number of photons per second with a 2 mr/hr dose rate at exit surface 40 of the collimating unit shown in FIG. 1 can be calculated by te equation of $$C = 2kfA \qquad (1)$$

where $C$ represents the number of photons per second, $k$ is the number of photons/cm$^2$sec/mr./hr; $A$ represents the area of the source, that is its diametrical extent, and $f$ represents the free space area fraction, that is, the ratio of the total area of spaces or passages provided between the collimating members 17 and 18 as shown respectively in FIGS. 2 and 3 to the area of the source 3.

Figure 5:
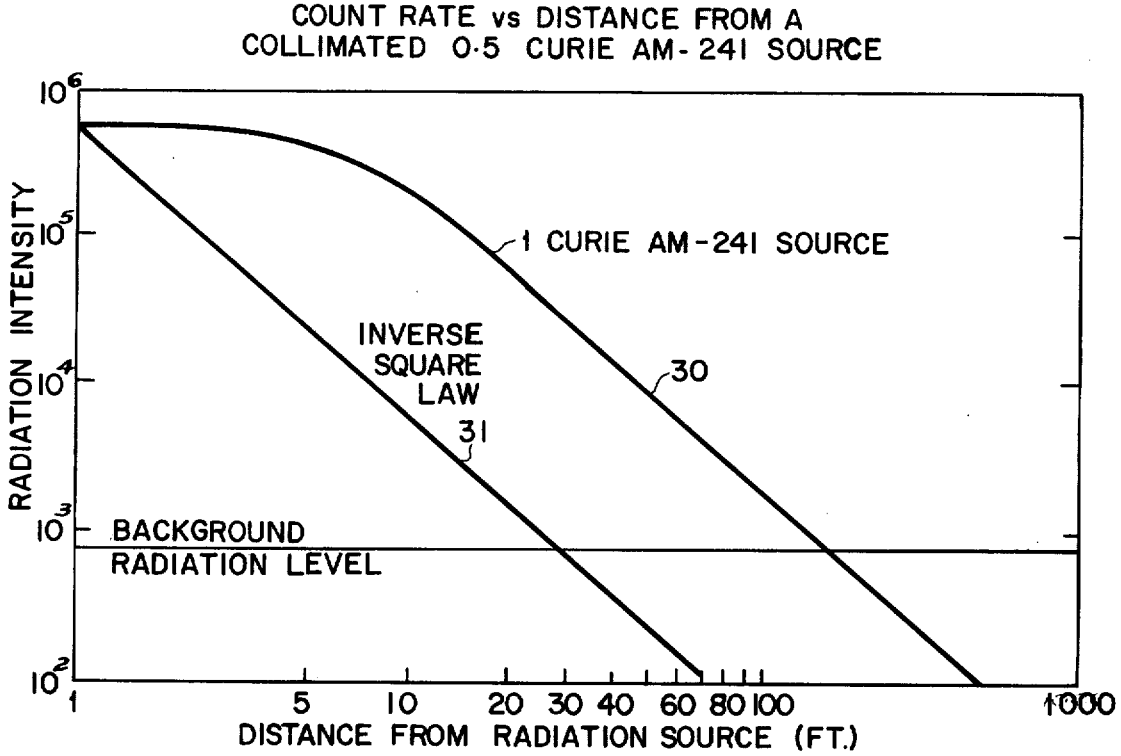
FIG. 5 is a graphic illustration in connection with Example I illustrating the count rate as an indication of radiation intensity versus distance from the radiation source; and, FIG. 6 is a graphic illustration in connection with Example II illustrating the count rate as an indication of radiation intensity versus distance from the radiation source.
Figure 6:
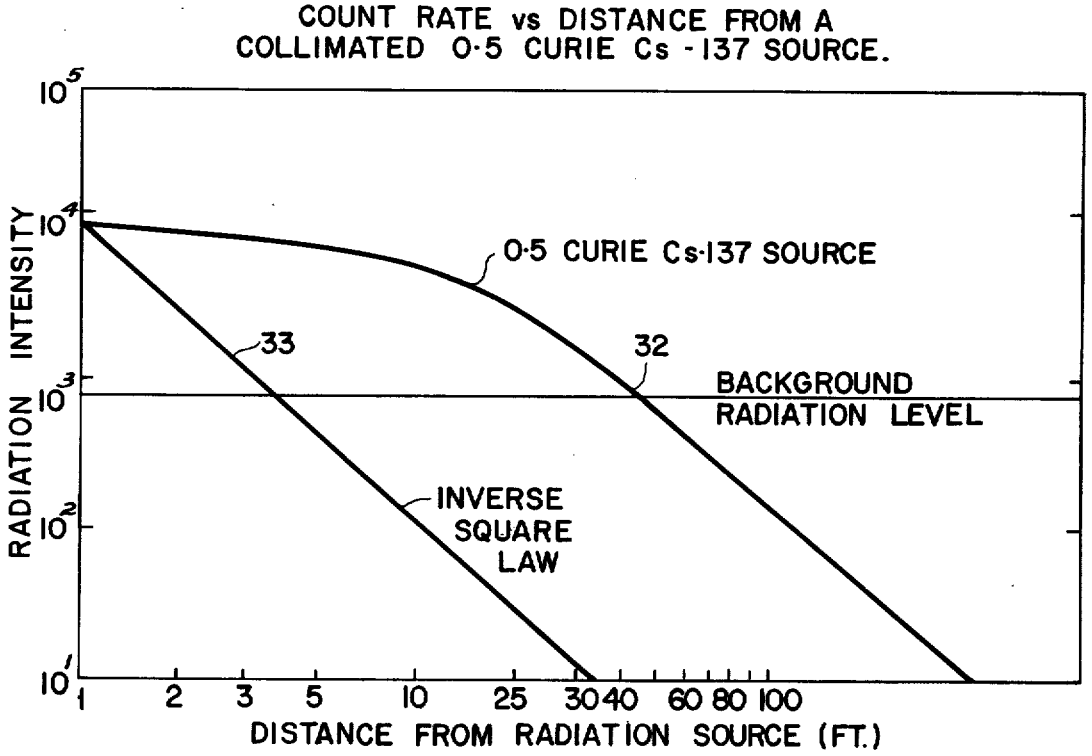

The count rate (the detected fraction of the photon emission rate) is also established by this equation or formula. As shown in FIGS. 5 and 6 the count rate, as so established is fairly constant until the diametrical extent or width of the radiation beam diverges to such an extent that it becomes larger than the diametrical extent of the detector crystal such as those shown in FIG. 4 at 30*a* to *d*. When this drop in count rate or radiation intensity takes place at this point, its diminishing strength with regard to the distance of its travel would first be only gradual. This is because the radiation emerging from individual parallel passages has not diverged sufficiently to be greater in cross sectional extent than the detector. When this happens the count rate commences to drop sharply. The distance along the beam is measured from the exit surface 40 and is represented by $r$, in the relationship of $$r = (LD/d) \qquad (2)$$

wherein $L$ equals the length of the collimating members, $D$ is equal to the diametrical extent of the detector crystal and $d$ is the approximate average diameter of the passages 20, as shown in FIG. 2 or depicted in FIG. 3 at 20 and 21. At this distance $r$, the count rate will begin to diminish in accordance with the inverse square law rule. Thus, from the foregoing, it can readily be seen that the construction of the collimator 2, particularly in connection with the collimating members depicted generally at 15 in FIG. 1 can be selected in accordance with their length and diametrical size when taking into consideration the transmission range or distance desired, the diametrical extent of the detector crystal, the tolerable diameter of the radiation beam as transmitted, and the minimum signal to background radiation level that is required in connection with the particular application.

In order to better understand the foregoing relationship as well as the advantages obtained by using the collimator unit 1 of the type shown in FIG. 1, the following examples are representative of the type of long distance transmission that may be utilized when employing low energy level gamma radiation sources.

EXAMPLE I

A one curie Americium-241 source collimator having a radiating face diameter of 0.92 inches was chosen having an average dose rate at its front face of approximately 0.40 mr. per hr. The detector crystal had a diameter of 1.5 inches. The collimating members were chosen to be a plurality of closely packed stainless steel tubes such as shown in FIG. 3. These tubes had an outside diameter of 0.125 inches and an inside diameter of 0.085 inches and were selected to be 7 inches long. It was found that the dose rate at the steel tube openings at the outer end of the collimator unit 2 had a maximum rate of 0.44 mr./hr. Thus, the Atomic Energy Commission limits, as previously explained in connection with radiation exposure, were not exceeded at the forward surface 40 of the collimator or the exit end plate 14 in FIG. 1.

The free space area fraction, $f$, was about 0.6, and the value for $k$ was approximately $8.9 \times 10^3$ photons/cm$^2$sec/mr./hr. By employing equation (1) to calculate emission rate, C, and by empirically determining count rates at various distances from the Am-241 source collimator, the results shown in FIG. 5 are obtained. The line 30 of FIG. 5 shows count rate as a measure of radiation intensity versus the distance from the radiation source. The background radiation level in connection with a particular experimental application is also shown. A diagonal line 31 representing the theoretical count rate in that situation where the radiated beam would follow an inverse square relationship is shown.

The collimated radiation signal or beam has approximately a 1 inch width at the front face 12 of the collimator and 8 inch width at 50 feet from the collimator unit 1.

It will be readily noted upon examination of FIG. 5 that the count rate as a function of radiation intensity does not fall off with an inverse square relationship immediately upon the emergence of the collimated radiation beam from the exit surface 40 of the collimator unit 2. In fact, by employing the equation (2) for determining the approximate maximum distance wherein the diminishing rate of the radiation intensity will follow an inverse square relationship, it will be seen that the distance as shown by FIG. 5 is approximately 10 feet. In the particular example here, the length of the collimators being 7 inches, the diameter D of the detector crystal being 1.5 inches, and the diametrical extent of one of the passages 21 as shown in FIG. 2 being approximately 0.085 inches, the distance obtained from equation (2) is calculated to be approximately 10 feet.

It also should be noted that in connection with FIG. 5 at point 30 the signal even at 50 feet from the radiation source is ten times the background radiation level. With conventional prior art collimators, using the same beam intensity, this same level could be obtained only at approximately 7 feet from the source as depicted at 31. The beam diameter at point 30 was determined to be approximately 8 inches. The signal to background ratio can be significantly increased by shielding the detector crystal. Also pulse height discrimination can be utilized in connection with the signal circuit means to obtain a better detection system at such distances.

EXAMPLE II

A collimator unit 2 was chosen employing collimating members such as 17 shown in FIG. 2 which specifically were 0.04 inch diameter tungsten rods being 1% thoriated. An 1.0 curie Cesium-137 source with an 0.92 inch radiating face was employed and the maximum experimental dosage rate at the exit surface 40 of the collimator was determined to be 1.3 mr. per hr., which is well within the Atomic Energy Commission exposure limits.

The free space area fraction $f$, was approximately 0.08 while the parameter $k$ equalled approximately $8.1 \times 10^2$ photons/cm$^2$ sec/mr./hr. By using these values with formula (1) the photon emission rate, C, at the exit surface 40 can be calculated.

The collimated radiation signal or beam was found to have a diametrical extent of approximately 1 inch at the collimator and only 2 inches at 50 feet from the collimator unit 1; which is point 32 in FIG. 6.

FIG. 6 shows the count rate versus distance from the Cesium-137 source collimator. As predicted by the maximum distance equation for r, using the data previously mentioned, as depicted in FIG. 6, it was found that an inverse square relationship was not followed by the radiation beam until approximately 60 feet. The count rate data obtained in employing this particular source collimator shows this to be true.

The background radiation level in FIG. 6 was the same as that in FIG. 5 so that if the disclosed collimator were not employed, the effective distance of transmission of a radiating beam of the same intensity would be only slightly more than 3 feet, which is point 33 in FIG. 6.

From the foregoing it can readily be seen that for long distance gamma ray transmission, that is, from about 50 feet upwards to several hundred feet, it is advantageous to employ a highly collimated radiation beam or signal which is effective with regard to background radiation levels. For such long distance transmission it can readily be seen that the signal to background radiation level can be significantly larger, as much as 10 to 1 or more.

From the examples just explained, the gamma radiation beam or signal is so highly collimated that its diameter at 50 feet in connection with the AM-241 source is only 8 inches and with respect to the Cesium-130 source is only 2 inches. Thus, the radiation exposure level with respect to working personnel in the area of the radiant energy transmission system is very much minimized.

It should be understood that the distance of effective transmission of the gamma radiation beam or signal is a function of the length of the collimator members, the diametrical extent of the detection crystal at the detector, as well as the approximate diameterical extent of the passages provided by the collimator members as shown assembled in FIGS. 2 and 3. One can relatively design and construct a collimator unit 2 as shown in FIG. 1 to meet the requirements of a particular detection crystal as well as the necessary transmission range by properly choosing the ratio of the length of the collimator members relative to the diameterical extent of a collimating passage provided by the bundled and assembled collimator members, such as depicted at 20 in FIG. 2 in the case of the collimator rods 17 and at 20 and 21 in FIG. 3 in the case of the collimator tubes 21. Thus, a more highly collimated beam can be obtained within practical limits by optimizing the length of the collimating members while minimizing the size or diametrical extent of the collimating members.

Although the invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

We claim:

1. A source assembly for a radiation detector comprising:

a. a collimator shielding body;

b. an elongated collimator assembly comprising a series of radiation opaque elongate members defining a plurality of parallel elongated gamma transmitting passages;

c. said collimator assembly being axially received in said body;

d. a gamma outlet window secured to said collimator shielding body and overlying an outlet end of said collimator assembly;

e. gamma inlet window secured to said collimator body in spaced relationship with the outlet window and overlying an inlet end of said collimator assembly;

f. a tubular source shield secured to the collimator body and defining a source chamber adjacent the inlet window;

g. a radiation source in the chamber and having a radiation face near said inlet window and aligned with said collimator assembly to emit gamma radiation through said elongated passages; and, h. a shielding cap removably secured to the shield body to permit facile replacement of the source while preventing emission of radiation rearwardly of the shielding body when the assembly is in use.

2. The source assembly according to claim 1 wherein the elongate members are rods secured in a bundle.

3. The source assembly according to claim 1 wherein the elongate members are tubes secured in a bundle.

* * * * *